US006454373B1

(12) United States Patent
Therien et al.

(10) Patent No.: US 6,454,373 B1
(45) Date of Patent: Sep. 24, 2002

(54) INK DROP DETECTOR WASTE INK REMOVAL SYSTEM

(75) Inventors: Patrick Therien, Battle Ground, WA (US); Wen-Li Su, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 17 days.

(21) Appl. No.: 09/773,873

(22) Filed: Jan. 31, 2001

(51) Int. Cl.[7] ..... B41J 2/01
(52) U.S. Cl. ..... 347/1; 347/33
(58) Field of Search ..... 347/1, 6, 19, 22–36, 347/81; 215/250.361, 256.5

(56) References Cited

U.S. PATENT DOCUMENTS

| | | | | |
|---|---|---|---|---|
| 4,310,846 A | | 1/1982 | Horike | 347/6 |
| 4,323,905 A | | 4/1982 | Reitberger et al. | 347/6 |
| 4,333,083 A | | 6/1982 | Aldridge | 347/81 |
| 5,036,340 A | | 7/1991 | Osborne | 347/19 |
| 5,109,239 A | | 4/1992 | Cobbs et al. | 347/19 |
| 5,255,009 A | * | 10/1993 | Bauer et al. | 347/81 |
| 5,798,775 A | * | 8/1998 | Takahashi et al. | 347/33 |
| 5,949,448 A | | 9/1999 | Man et al. | 347/33 |
| 6,086,190 A | | 7/2000 | Schantz et al. | 347/81 |
| 6,094,981 A | | 8/2000 | Hochstein | 73/170.17 |
| 6,155,667 A | | 12/2000 | Eckard et al. | 347/33 |

FOREIGN PATENT DOCUMENTS

| | | | | |
|---|---|---|---|---|
| JP | 07205438 | * | 8/1995 | 347/33 |

OTHER PUBLICATIONS

Hewlett–Packard Company, U.S. patent application Ser. No. 09/560,430, filed Apr. 28, 2000, entitled "Electrical Interconnect Cleaning System for Inkjet Cartridges".

* cited by examiner

*Primary Examiner*—John S. Hilten
*Assistant Examiner*—Shih-wen Hsieh
(74) *Attorney, Agent, or Firm*—Christopher B. Miller

(57) ABSTRACT

A waste ink removal system cleans ink residue from an electrostatic sensing element of an ink drop detector in a printing mechanism when a scraper, supported by a base, is actuated between a retracted position and an engaged position. The system also includes a debris receptacle and/or an absorber which the scraper contacts, after scraping ink from the sensing element, to remove the ink from the scraper surface. A method of cleaning ink residue from an electrostatic sensing element of an ink drop detector, and a printing mechanism having such a waste ink removal system are also provided.

26 Claims, 4 Drawing Sheets

INK DROP DETECTOR WASTE INK REMOVAL SYSTEM

INTRODUCTION

The present invention relates generally to printing mechanisms, such as inkjet printers or inkjet plotters. More particularly the present invention relates to a waste ink removal system for cleaning ink residue and debris from a target area of an ink drop detector in a printing mechanism.

Printing mechanisms often include an inkjet printhead which is capable of forming an image on many different types of media. The inkjet printhead ejects droplets of colored ink through a plurality of orifices and onto a given media as the media is advanced through a printzone. The printzone is defined by the plane created by the printhead orifices and any scanning or reciprocating movement the printhead may have back-and-forth and perpendicular to the movement of the media. Conventional methods for expelling ink from the printhead orifices, or nozzles, include piezo-electric and thermal techniques which are well-known to those skilled in the art. For instance, two earlier thermal ink ejection mechanisms are shown in U.S. Pat. Nos. 5,278,584 and 4,683,481, both assigned to the present assignee, the Hewlett-Packard Company.

In a thermal inkjet system, a barrier layer containing ink channels and vaporization chambers is located between a nozzle orifice plate and a substrate layer. This substrate layer typically contains linear arrays of heater elements, such as resistors, which are individually addressable and energized to heat ink within the vaporization chambers. Upon heating, an ink droplet is ejected from a nozzle associated with the energized resistor. The inkjet printhead nozzles are typically aligned in one or more linear arrays substantially parallel to the motion of the print media as the media travels through the printzone. The length of the linear nozzle arrays defines the maximum height, or "swath" height of an imaged bar that would be printed in a single pass of the printhead across the media if all of the nozzles were fired simultaneously and continuously as the printhead was moved through the printzone above the media.

Typically, the print media is advanced under the inkjet printhead and held stationary while the printhead passes along the width of the media, firing its nozzles as determined by a controller to form a desired image on an individual swath, or pass. The print media is usually advanced between passes of the reciprocating inkjet printhead in order to avoid uncertainty in the placement of the fired ink droplets. If the entire printable data for a given swath is printed in one pass of the printhead, and the media is advanced a distance equal to the maximum swath height in-between printhead passes, then the printing mechanism will achieve its maximum throughput.

Often, however, it is desirable to print only a portion of the data for a given swath, utilizing a fraction of the available nozzles and advancing the media a distance smaller than the maximum swath height so that the same or a different fraction of nozzles may fill in the gaps in the desired printed image which were intentionally left on the first pass. This process of separating the printable data into multiple passes utilizing subsets of the available nozzles is referred to by those skilled in the art as "shingling," "masking," or using "print masks." While the use of print masks does lower the throughput of a printing system, it can provide offsetting benefits when image quality needs to be balanced against speed. For example, the use of print masks allows large solid color areas to be filled in gradually, on multiple passes, allowing the ink to dry in parts and avoiding the large-area soaking and resulting ripples, or "cockle," in the print media that a single pass swath would cause.

A printing mechanism may have one or more inkjet printheads, corresponding to one or more colors, or "process colors" as they are referred to in the art. For example, a typical inkjet printing system may have a single printhead with only black ink; or the system may have four printheads, one each with black, cyan, magenta, and yellow inks; or the system may have three printheads, one each with cyan, magenta, and yellow inks. Of course, there are many more combinations and quantities of possible printheads in inkjet printing systems, including seven and eight ink/printhead systems.

Each process color ink is ejected onto the print media in such a way that the drop size, relative position of the ink drops, and color of a small, discreet number of process inks are integrated by the naturally occurring visual response of the human eye to produce the effect of a large colorspace with millions of discernable colors and the effect of a nearly continuous tone. In fact, when these imaging techniques are performed properly by those skilled in the art, near-photographic quality images can be obtained on a variety of print media using only three to eight colors of ink.

This high level of image quality depends on many factors, several of which include: consistent and small ink drop size, consistent ink drop trajectory from the printhead nozzle to the print media, and extremely reliable inkjet printhead nozzles which do not clog.

To this end, many inkjet printing mechanisms contain a service station for the maintenance of the inkjet printheads. These service stations may include scrapers, ink-solvent applicators, primers, and caps to help keep the nozzles from drying out during periods of inactivity. Additionally, inkjet printing mechanisms often contain service routines which are designed to fire ink out of each of the nozzles and into a waste spittoon in order to prevent nozzle clogging.

Despite these preventative measures, however, there are many factors at work within the typical inkjet printing mechanism which may clog the inkjet nozzles, and inkjet nozzle failures may occur. For example, paper dust may collect on the nozzles and eventually clog them. Ink residue from ink aerosol or partially clogged nozzles may be spread by service station printhead scrapers into open nozzles, causing them to be clogged. Accumulated precipitates from the ink inside of the printhead may also occlude the ink channels and the nozzles. Additionally, the heater elements in a thermal inkjet printhead may fail to energize, despite the lack of an associated clogged nozzle, thereby causing the nozzle to fail.

Clogged or failed printhead nozzles result in objectionable and easily noticeable print quality defects such as banding (visible bands of different hues or colors in what would otherwise be a uniformly colored area) or voids in the image. In fact, inkjet printing systems are so sensitive to clogged nozzles, that a single clogged nozzle out of hundreds of nozzles is often noticeable and objectionable in the printed output.

It is possible, however, for an inkjet printing system to compensate for a missing nozzle by removing it from the printing mask and replacing it with an unused nozzle or a used nozzle on a later, overlapping pass, provided the inkjet system has a way to tell when a particular nozzle is not functioning. In order to detect whether an inkjet printhead nozzle is firing, a printing mechanism may be equipped with a number of different ink drop detector systems.

One type of ink drop detector system utilizes a piezoelectric target surface that produces a measurable signal when ink droplets contact the target surface. Unfortunately, however, this type of technology is expensive and often is unable to detect the extremely small drops of ink used in inkjet printing systems with photographic image quality.

Another type of ink drop detector utilizes an optical sensor which forms a measurable signal when an ink droplet passes through a light beam from a sensory circuit. Unfortunately, this method is subject to extremely tight alignment tolerances which are difficult and expensive to setup and maintain. Additionally, an optical ink drop detection system is susceptible to the ink aerosol which results from the firing of the inkjet printhead inside of the printing mechanism. The aerosol coats the optical sensor over time, degrading the optical sensor signal and eventually preventing the optical sensor from functioning.

A more effective solution for ink drop detection is to use a low cost ink drop detection system, such as the one described in U.S. Pat. No. 6,086,190 assigned to the present assignee, Hewlett-Packard Company. This drop detection system utilizes an electrostatic sensing element which is imparted with an electrical stimulus when struck by a series of ink drop bursts ejected from an inkjet printhead. The electrostatic sensing element may be made sufficiently large so that printhead alignment is not critical, and the sensing element may function with amounts of ink or aerosol on the sensing element surface which would incapacitate other types of drop detection sensors.

In practical implementation, however, this electrostatic sensing element has some limitations. First, successive drops of ink, drying on top of one another quickly form stalagmites of dried ink which may grow toward the printhead. Since it is preferable to have the electrostatic sensing element very close to the printhead for more accurate readings, these stalagmites may eventually interfere with or permanently damage the printhead, adversely affecting print quality. Second, as the ink residue dries, it remains conductive and may short out the drop detector electronics as the ink residue grows and spreads. Thus, this dried residue impairs the ability of the sensor to measure the presence of drops properly.

Therefore, it is desirable to have a method and mechanism for effectively removing the waste ink residue from an electrostatic ink drop detector in an inkjet printing mechanism.

SUMMARY OF THE INVENTION

According to one aspect of the present invention, a waste ink removal system is provided for cleaning ink residue from an ink drop sensor in a printing mechanism. The waste ink removal system includes a base, an actuator, and a scraper, supported by the base, which scrapes ink residue from the ink drop sensor when moved by the actuator from a retracted position to an engaged position. The waste ink removal system also includes an absorber which the scraper contacts in the engaged position to remove the ink residue from the scraper.

According to another aspect of the present invention, a printing mechanism may be provided with a waste ink removal system as described above.

According to yet another aspect of the present invention, a waste ink removal system is provided for cleaning ink residue from an ink drop sensor in a printing mechanism. The waste ink removal system includes a base, an actuator, and a scraper, supported by the base, which scrapes ink residue from the ink drop sensor when moved by the actuator from a retracted position to an engaged position. The waste ink removal system also includes a debris receptacle having an opening into which the scraper pushes ink residue after scraping the ink residue from the sensing element.

According to a further aspect of the present invention, a method is provided for cleaning ink residue from ink drop sensor in a printing mechanism. The method includes moving a scraper between a retracted position and an engaged position, scraping ink residue from the ink drop sensor with the scraper while moving to the engaged position, and removing ink residue from the scraper surface, while the scraper is in the engaged position, through contact with an absorber.

One goal of the present invention is to provide a waste ink removal system for cleaning ink and ink residue from the sensing element of an electrostatic ink drop detector to prevent ink build-up on the sensor from contacting and thereby damaging the printheads, as well as to ensure a clean sensor surface to enable accurate drop detection readings that can be used to provide consumers with a reliable, economical inkjet printing unit.

DETAILED DESCRIPTION OF THE PREFERRED EMBODIMENTS

Figure 1:
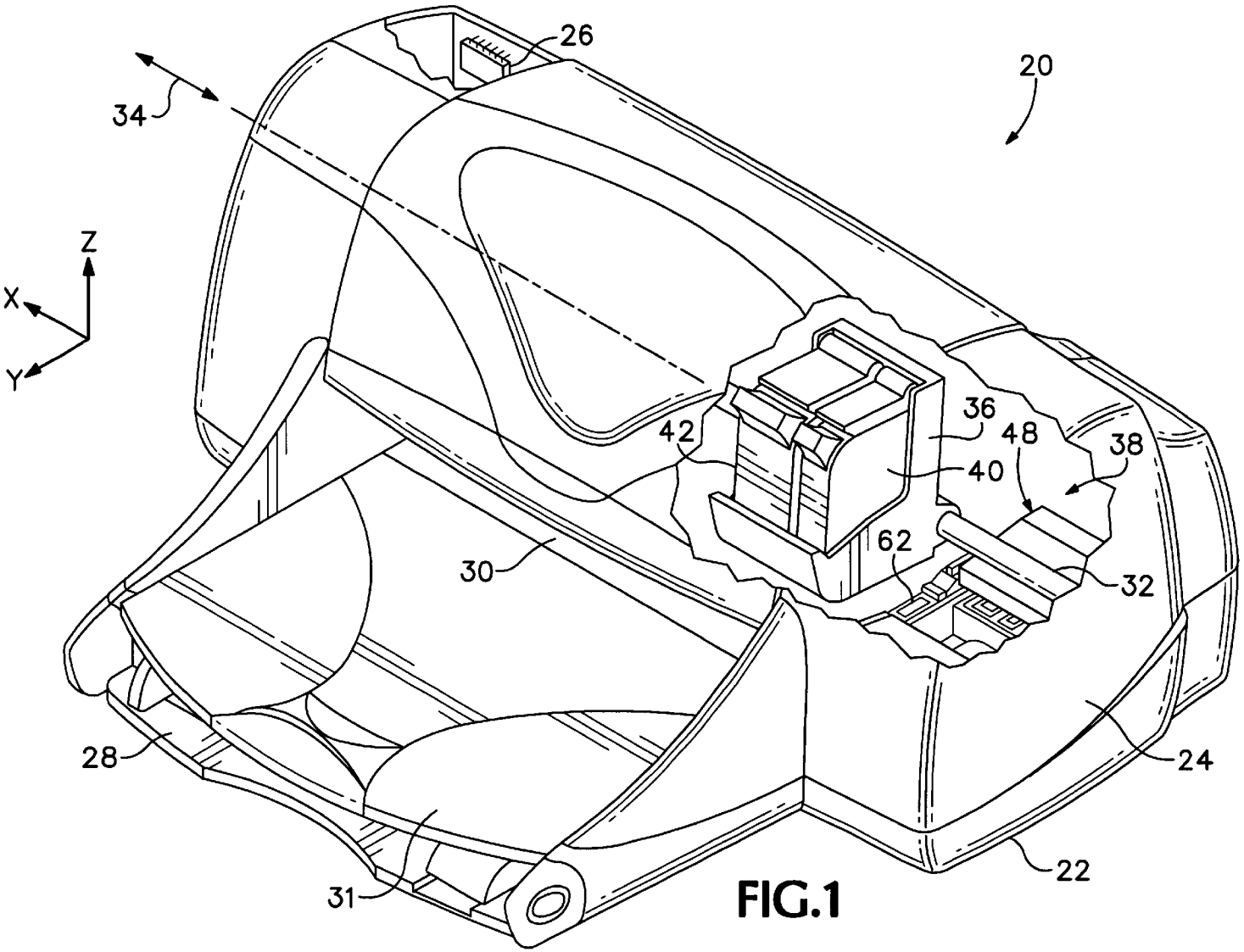
FIG. 1 is a fragmented perspective view of one form of an inkjet printing mechanism, here including a service station having an electrostatic ink drop detector with an electrostatic ink drop detector waste ink removal system.

FIG. 1 illustrates an embodiment of a printing mechanism, here shown as an inkjet printer 20, constructed in accordance with the present invention, which may be used for printing on a variety of media, such as paper, transparencies, coated media, cardstock, photo quality papers, and envelopes in an industrial, office, home or other environment. A variety of inkjet printing mechanisms are commercially available. For instance, some of the printing mechanisms that may embody the concepts described herein include desk top printers, portable printing units, wide-format printers, hybrid electrophotographic-inkjet printers, copiers, cameras, video printers, and facsimile machines, to name a few. For convenience the concepts introduced herein are described in the environment of an inkjet printer 20.

While it is apparent that the printer components may vary from model to model, the typical inkjet printer 20 includes a chassis 22 surrounded by a frame or casing enclosure 24, typically of a plastic material. The printer 20 also has a printer controller, illustrated schematically as a microprocessor 26, that receives instructions from a host device, such as a computer or personal data assistant (PDA) (not shown). A screen coupled to the host device may also be used to display visual information to an operator, such as the printer status or a particular program being run on the host device. Printer host devices, such as computers and PDA's, their input devices, such as a keyboards, mouse devices, stylus devices, and output devices such as liquid crystal display screens and monitors are all well known to those skilled in the art.

A conventional print media handling system (not shown) may be used to advance a sheet of print media (not shown) from the media input tray 28 through a printzone 30 and to an output tray 31. A carriage guide rod 32 is mounted to the chassis 22 to define a scanning axis 34, with the guide rod 32 slideably supporting an inkjet carriage 36 for travel back and forth, reciprocally, across the printzone 30. A conventional carriage drive motor (not shown) may be used to propel the carriage 36 in response to a control signal received from the controller 26. To provide carriage positional feedback information to controller 26, a conventional encoder strip (not shown) may be extended along the length of the printzone 30 and over a servicing region 38. A conventional optical encoder reader may be mounted on the back surface of printhead carriage 36 to read positional information provided by the encoder strip, for example, as described in U.S. Pat. No. 5,276,970, also assigned to the Hewlett-Packard Company, the present assignee. The manner of providing positional feedback information via the encoder strip reader, may also be accomplished in a variety of ways known to those skilled in the art.

In the printzone 30, the media sheet receives ink from an inkjet cartridge, such as a black ink cartridge 40 and a color inkjet cartridge 42. The cartridges 40 and 42 are also often called "pens" by those in the art. The black ink pen 40 is illustrated herein as containing a pigment-based ink. For the purposes of illustration, color pen 42 is described as containing three separate dye-based inks which are colored cyan, magenta, and yellow, although it is apparent that the color pen 42 may also contain pigment-based inks in some implementations. It is apparent that other types of inks may also be used in the pens 40 and 42, such as paraffin-based inks, as well as hybrid or composite inks having both dye and pigment characteristics. The illustrated printer 20 uses replaceable printhead cartridges where each pen has a reservoir that carries the entire ink supply as the printhead reciprocates over the printzone 30. As used herein, the term "pen" or "cartridge" may also refer to an "off-axis" ink delivery system, having main stationary reservoirs (not shown) for each ink (black, cyan, magenta, yellow, or other colors depending on the number of inks in the system) located in an ink supply region. In an off-axis system, the pens may be replenished by ink conveyed through a conventional flexible tubing system from the stationary main reservoirs which are located "off-axis" from the path of printhead travel, so only a small ink supply is propelled by carriage 36 across the printzone 30. Other ink delivery or fluid delivery systems may also employ the systems described herein, such as "snapper" cartridges which have ink reservoirs that snap onto permanent or semi-permanent print heads.

The illustrated black pen 40 has a printhead 44, and color pen 42 has a tri-color printhead 46 which ejects cyan, magenta, and yellow inks. The printheads 44, 46 selectively eject ink to form an image on a sheet of media when in the printzone 30. The printheads 44, 46 each have an orifice plate with a plurality of nozzles formed therethrough in a manner well known to those skilled in the art. The nozzles of each printhead 44, 46 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 34, with the length of each array determining the maximum image swath for a single pass of the printhead. The printheads 44, 46 are thermal inkjet printheads, although other types of printheads may be used, such as piezoelectric printheads. The thermal printheads 44, 46 typically include a plurality of resistors which are associated with the nozzles. Upon energizing a selected resistor, a bubble of gas is formed which ejects a droplet of ink from the nozzle and onto the print media when in the printzone 30 under the nozzle. The printhead resistors are selectively energized in response to firing command control signals delivered from the controller 26 to the printhead carriage 36.

Between print jobs, the inkjet carriage 36 moves along the carriage guide rod 32 to the servicing region 38 where a service station 48 may perform various servicing functions known to those in the art, such as, priming, scraping, and capping for storage during periods of non-use to prevent ink from drying and clogging the inkjet printhead nozzles.

Figure 2:
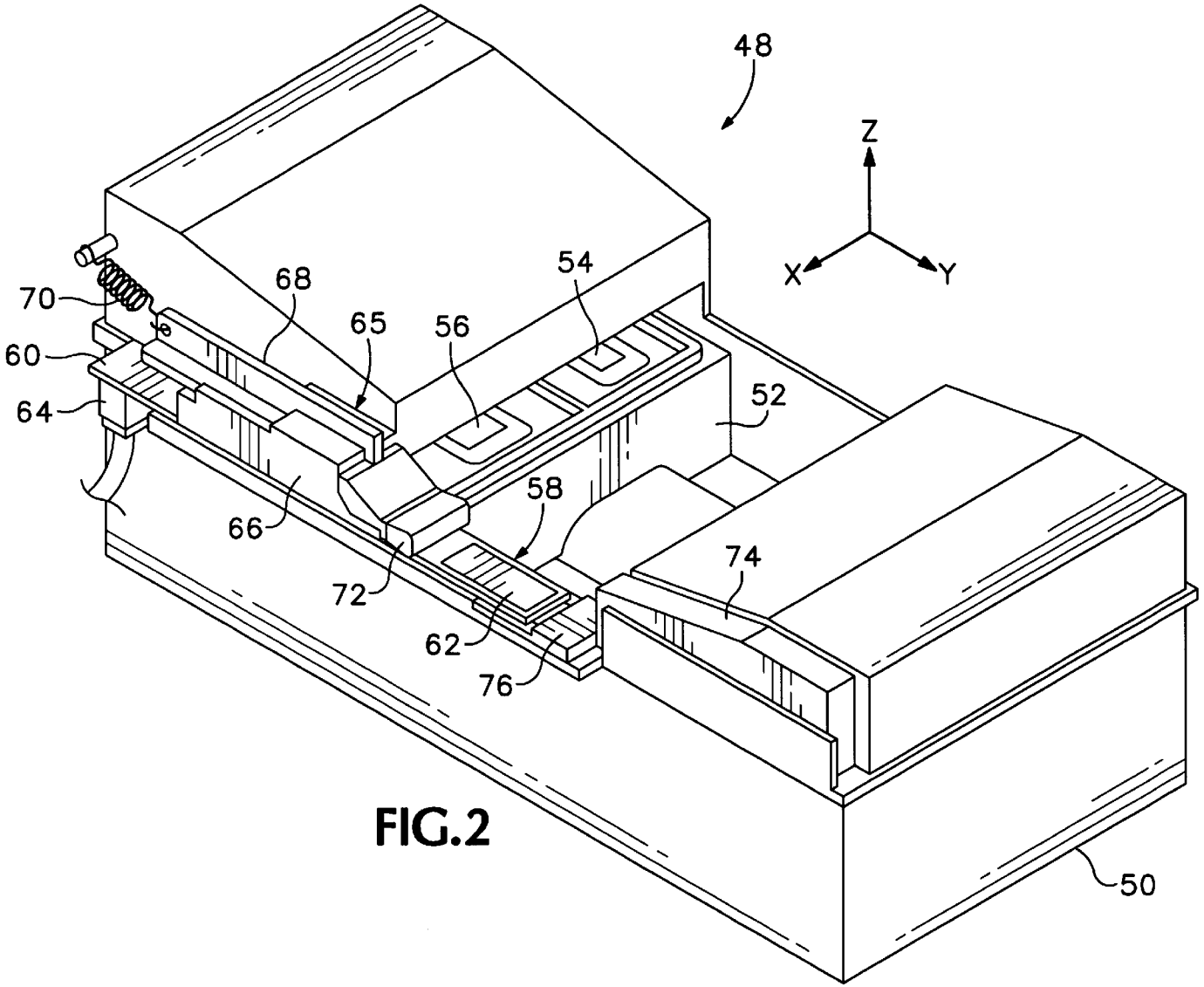
FIG. 2 is an enlarged perspective view of the service station of FIG. 1

FIG. 2 shows the service station 48 in detail. A service station frame 50 is mounted to the chassis 22, and houses a moveable pallet 52. The moveable pallet 52 may be driven by a motor (not shown) to move in the frame 50 in the positive and negative Y-axis directions. The moveable pallet 52 may be driven by a rack and pinion gear powered by the service station motor in response to the microprocessor 26 according to methods known by those skilled in the art. An example of such a rack and pinion system in an inkjet cleaning service station can be found in U.S. Pat. No. 5,980,018, assigned to the Hewlett-Packard Company, also the current assignee. The end result is that pallet 52 may be moved in the positive Y-axis direction to a servicing position and in the negative Y-axis direction to an uncapped position. The pallet 52 supports a black printhead cap 54 and a tri-color printhead cap 56 to seal the printheads 44 and 46, respectively, when the moveable pallet 52 is in the servicing position, here a capping position.

FIG. 2 also shows an ink drop detector system 58 supported by the service station frame 50. Clearly, the ink drop detector system 58 could be mounted in other locations along the printhead scanning axis 34, including the right side of the service station frame 50, inside the service station 48, or the opposite end of the printer from the service station 48, for example. However, the illustrated location of the ink drop detector 58 is the preferred location, and will be used to illustrate the preferred principles of manufacture and operation, although other locations may be more suitable in other implementations.

The ink drop detector system 58 has a printed circuitboard assembly (PCA) 60 which is supported by the service station frame 50. The PCA 60 has a conductive electrostatic sensing element 62, or "target" on the upper forward end onto which ink droplets may be fired and detected according to the apparatus and method described in U.S. Pat. No. 6,086,190, assigned to the Hewlett-Packard Company, the present assignee. The target 62 is preferably constructed of soft gold. The PCA 60 contains various electronics (not shown) for filtering and amplification of drop detection signals received from the target 62. An electrical conductor 64 links the ink drop detector 58 to controller 26 for drop detection signal processing. The ink drop detector system 58 also has a waste ink removal system 65.

Attached to the PCA 60 is a stationary slider cover 66 which acts as a guide for the movement of a scraper slider 68. The slider cover 66 may also be designed to shield electrical components on the ink drop detector 58 from ink aerosol generated from the printheads 44, 46. The scraper slider 68 is capable of being moved in the positive and negative Y-axis directions, and is biased towards the rear of the service station 48 (negative Y-axis direction) by a biasing member, such as a tension spring or return spring 70, which is connected between the scraper slider 68 and a post projecting from the service station frame 50. The scraper slider 68 has a scraper 72 attached or preferably overmolded onto a front end 73 of the slider 68. The width of scraper 72 is sufficient to scrape the entire width of the target 62. The scraper 72 is preferably constructed of an elastomer, such as a thermoplastic elastomer (TPE) which is overmolded onto the slider 68. The scraper 72 may also be constructed of a non-overmolded, rigid one-piece plastic. The return spring 70 is preferably mounted at an angle above the slider 68 in order to impart a minimal downward scraping force to scraper 72, thereby minimizing the wear of target 62. The ink drop detector 58 also includes an absorber 74 which may be constructed of cellulose or polyester, but is preferably constructed of a sintered plastic. The absorber 74 has an absorber deposition surface 76 which is configured to receive ink scraped from the electrostatic sensing element 62 when the scraper 72 is moved in the positive Y-axis direction across the sensing element 62 and onto the absorber deposition surface 76.

Figure 3:
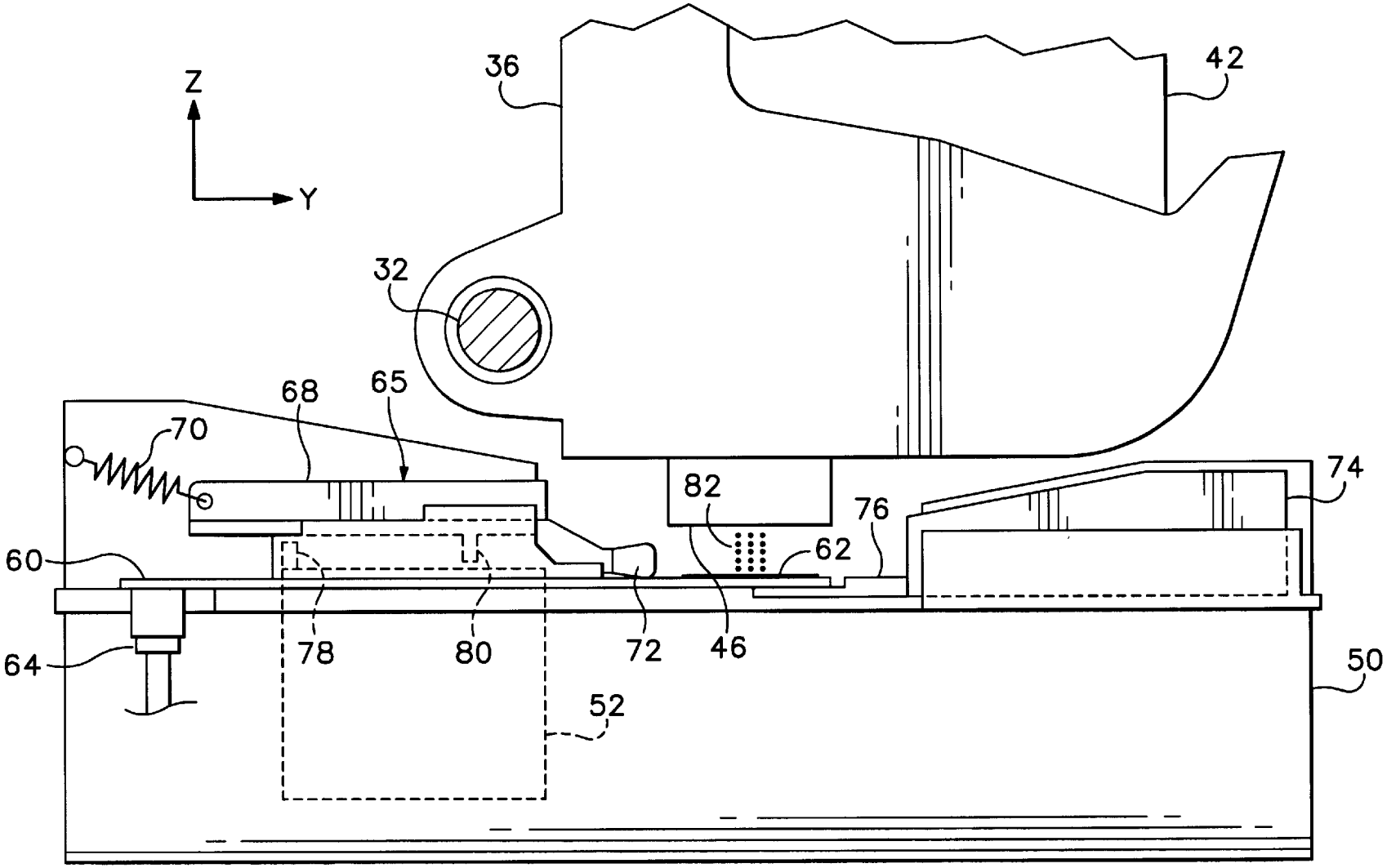
FIG. 3 is an enlarged side elevational view of the service station of FIG. 1 shown with an inkjet printhead firing ink onto the electrostatic ink drop detector.
Figure 4:
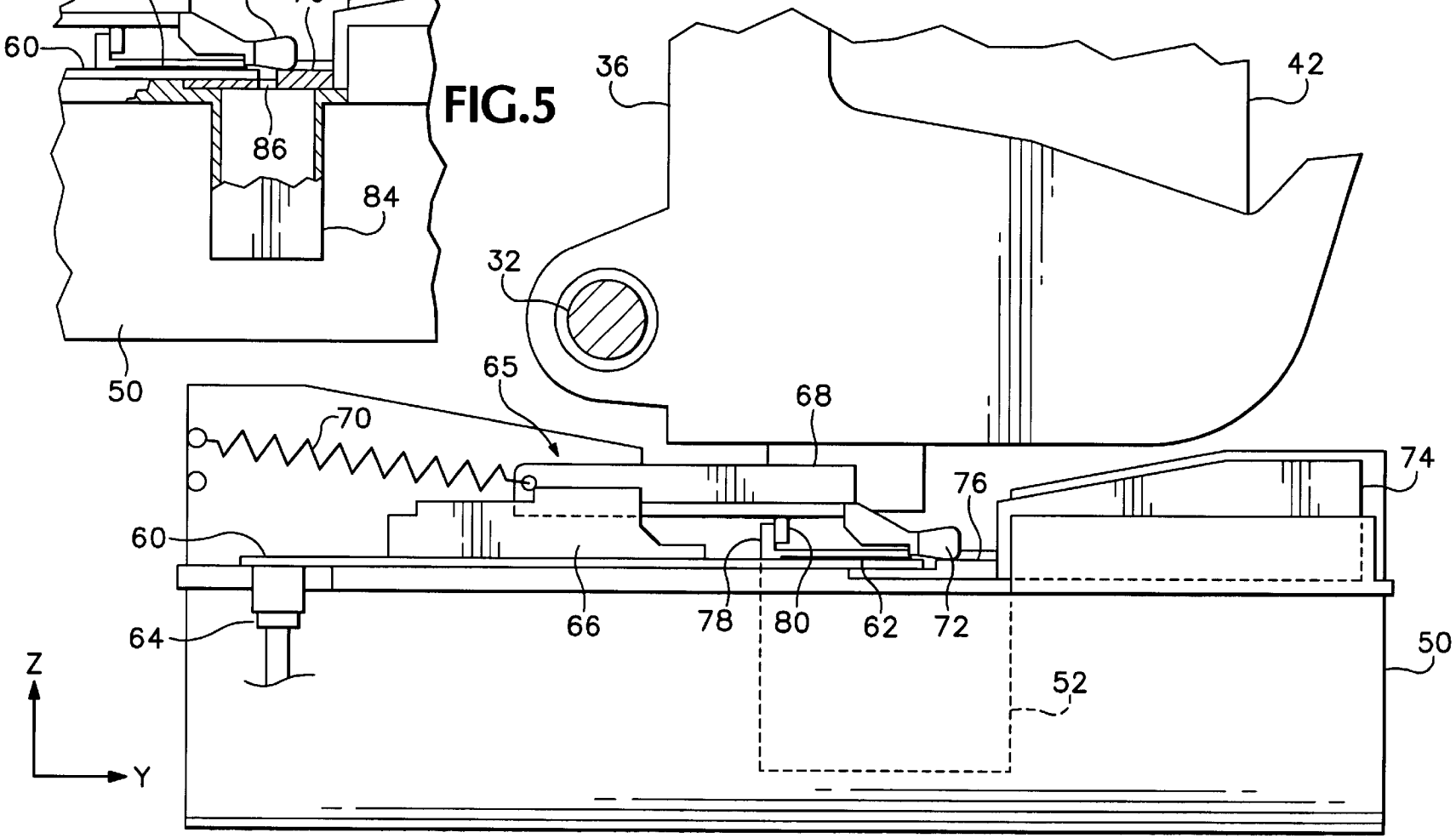
FIG. 4 is an enlarged side elevational view of the service station of FIG. 1, showing the electrostatic ink drop detector being cleaned by the waste ink removal system.

Movement is preferably imparted to the scraper slider 68 through movement of the moveable pallet 52 as the pallet 52 moves from the uncapped position shown in FIG. 3 to the capped position shown in FIG. 4. FIGS. 3 and 4 also show a moveable pallet tower 78 which protrudes upwardly from the moveable pallet 52 on the side of the moveable pallet 52 adjacent to the scraper slider 68. A scraper slider leg 80, which is integral to the scraper slider 68, protrudes inwardly and downwardly towards the moveable pallet 52. The moveable pallet tower 78 is sized and positioned to engage the scraper slider leg 80 as the moveable pallet 52 is moved from the uncapped position of FIG. 3. to the capped position of FIG. 4. The force exerted by the moveable pallet tower 78 on the scraper slider leg 80 is greater than the opposing force of the return spring 70, and moving the moveable pallet 52 causes the scraper slider 68 to move from the fully retracted position shown in FIG. 3 to the fully engaged position of FIG. 4. As the scraper slider 68 moves to the engaged position, the scraper 72 is scraped across the electrostatic target 62 and onto the absorber deposition surface 76, as shown in FIG. 4. The scraper 72 remains on the absorber deposition surface 76 while the moveable pallet 52 is in the capped position, allowing the waste ink to soak into the absorber 74 via capillary action. When the moveable pallet 52 is returned to the uncapped position, the scraper slider 68 is also retracted due to the force of return spring 70. As moveable pallet 52 retracts, scraper 72 slides from the position shown in FIG. 4 on the absorber deposition surface 76, then back across the target 62 and into the retracted position shown in FIG. 3.

While the preferred method of actuating the scraper 72 is through the above-described movement of moveable pallet 52, it should be apparent that other structural equivalents may be substituted to act as the actuator for the scraper 72, including, for example, a solenoid or a motor which operate in response to the controller 26.

While the moveable pallet 52 is in the uncapped position and the scraper 72 is in the retracted position, as shown in FIG. 3, the inkjet carriage 36 may be moved along the carriage guide rod 32 until one or more of the printheads 44, 46 are positioned directly over the electrostatic sensing target 62. For illustration purposes, the tri-color printhead 46 is shown positioned over target 62 in FIG. 3, although it is apparent that either of the printheads 44, 46 may be positioned over the target 62 either one at a time or in various simultaneous combinations if allowed by the size of the target 62, the size of each printhead, and the spacing between the printheads.

The preferred spacing between the printheads 44, 46 and the target 62 is on the order of two millimeters. Once the printhead 46 is properly aligned with the target 62, the controller 26 causes ink droplets 82 to be fired from printhead 46 onto the target 62. An electrical drop detect signal is generated by the ink droplets 82 as they contact the target 62, and this signal is captured by the electronics of PCA 60. The drop detect signal is then analyzed by controller 26 to determine whether or not various nozzles of printhead 46 are spitting ink properly or whether they are clogged. A preferred method of analyzing signals from an electrostatic target ink drop detector is shown in U.S. Pat. No. 6,086,190, also assigned to the present assignee, the Hewlett-Packard Company. Based on the determination made by the controller 26 as to whether each nozzle is functioning properly, the controller 26 may adjust the print masks to substitute functioning nozzles for any malfunctioning nozzles to provide consistent high-quality printed output while still using a printhead with permanently clogged nozzles.

In order to ensure that a reliable measurement may be made by the ink drop detector 58, it is desirable to remove ink residue from the target 62 after a measurement or series of measurements have been made to prevent excessive deposits of dried ink from accumulating on the surface of target 62. Dried ink deposits may short out the electrostatic sensing target 62, degrading the ability of the ink drop detector system 58 to make measurements. Additionally, dried ink deposits may accumulate over time to form stalagmites which eventually grow to interfere with the printheads 44, 46, possibly damaging nozzles which hit the stalagmites, a process known as "stalagmite crashes."

Accordingly, the scraper 72 is scraped across the target 62 every time the moveable pallet 52 is moved to the capping position to seal the printheads 44–68 as described above. Prior to moving the pallet 52, the inkjet carriage 36 is preferably moved past the ink drop detector 58 and over the servicing region 38 until black printhead cap 54 aligns with black printhead 44, and tri-color printhead cap 56 aligns with tri-color printhead 46. When the printheads 44, 46 are in the capping position, the scraper slider 68 and the scraper 72 are free to move without interference from the pens 40, 42 or the carriage 36.

The previously described motion of the scraper 72, as it traverses across the target 62 into the engaged position on the absorber deposition surface 76, forces the wet ink from the target 62 onto the absorber deposition surface 76 while also pushing away any built-up deposits of dried ink on the target 62 which might otherwise have begun to form stalagmites.

Using the embodiment of the waste ink removal system shown in FIGS. 1–4, stalagmites and other solid debris, if present on the target 62, are pushed onto the absorber deposition surface 76. A printer control routine used by controller 26 is ideally adjusted to perform ink drop detection measurements just prior to capping. The immediately following process of moving the pallet 52 into the capping position activates the scraper 72, and the scraper 72 removes the ink from the target 62 while the ink is still wet, thereby minimizing the possibility that stalagmites or dried ink are forming on the target 62.

Figure 5:
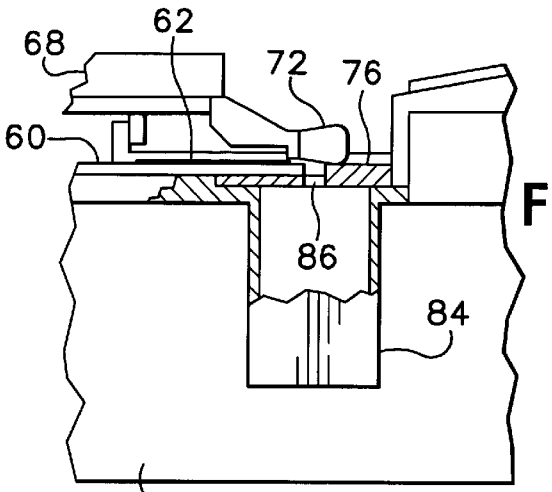
FIG. 5 is an enlarged, fragmented, side elevational view of the waste ink removal system, showing an integrated debris receptacle.

Despite efforts to remove the ink from the target 62 while it is still wet, dried ink debris may still be formed on target 62, and subsequently pushed onto the absorber deposition surface 76. In order to deal with this possibility, an alternative embodiment is illustrated in FIG. 5. A debris receptacle 84 may be molded into the service station frame 50, as shown in partial cross-section in FIG. 5. The debris receptacle 84 is preferably located below the end of PCA 60 near the absorber deposition surface 76. The debris receptacle has an opening 86 which is located between the front end of the PCA 60 and the absorber deposition surface 76. In this alternative embodiment, as scraper 72 is moved across the target 62 and towards the absorber deposition surface 76, any dried debris and some of the wet ink residue falls into the debris receptacle 84 through the debris receptacle opening 86. Thereafter, the scraper 72 completes the movement to the engaged position and rests on the absorber deposition surface 76 to allow any clinging wet ink to be absorbed.

In a further alternative embodiment, the absorber 74 and the absorber deposition surface 76 may be omitted, allowing the ink residue and ink debris to be deposited solely into the debris receptacle 84. By avoiding the problem of solid debris accumulation on the absorber deposition surface 76, this embodiment prevents the scraper 72 from dragging solid debris back from the absorber deposition surface 76 and onto the target 62.

The scraper 72 remains in contact with the absorber deposition surface 76 for the duration that the printheads 44, 46 are capped, allowing time for any wet ink which has been scraped from the target, and which may now be clinging to the scraper, to be pulled into the absorber deposition surface 76 through capillary action of the absorber 74. In fact, prototype testing of the illustrated absorber 74 have shown that ink deposited on the absorber deposition surface 76 flows under capillary action throughout the absorber 74. Thus, the size of the absorber may be designed to hold various volumes of ink, and preferably, enough ink to last the expected lifetime of the printer 20.

When the moveable pallet 52 is moved to the uncapped position, scraper 72 is retracted by return spring 70, providing clearance for the inkjet carriage 36 to move along carriage guide rod 32 and into the printzone 30 for printing. Using information from the ink drop detector measurements, print masks may be adjusted to replace clogged nozzles for optimum image quality.

A waste ink removal system 65, used in conjunction with an electrostatic ink drop detector system 58, provides the ability to remove wet ink from the target 62 before it dries. A waste ink removal system 65 also provides the ability to remove dried-ink buildup before it has a chance to form stalagmites, thereby preventing damage to the printheads 44, 46. Therefore, a waste ink removal system enables a printing mechanism to reliably use ink drop detection readings to provide users with consistent, high-quality, and economical inkjet output despite printheads 44, 46 which may clog over time. In discussing various components of the ink drop detector 58 and the service station 48, various benefits have been noted above.

It is apparent that a variety of other structurally equivalent modifications and substitutions may be made to construct an ink drop detector waste ink removal system according to the concepts covered herein depending upon the particular implementation, while still falling within the scope of the claims below.

We claim:

1. A waste ink removal system for cleaning ink residue from an ink drop sensor in a printing mechanism, comprising:

a frame;

an actuator;

a scraper, supported by the frame, which scrapes ink residue from the ink drop sensor when moved by the actuator from a retracted position to an engaged position;

an absorber which the scraper contacts in the engaged position to remove the ink residue from the scraper; and a guide cover which controls motion of the scraper between the retracted position and the engaged position.

2. A waste ink removal system according to claim 1 wherein the absorber further comprises an absorber deposition surface which receives and removes ink residue from the scraper when the scraper is in the engaged position.

3. A waste ink removal system according to claim 2 wherein:

the drop sensor has a target surface which defines a plane; and the absorber deposition surface substantially lies in said plane.

4. A waste ink removal system according to claim 3 wherein the scraper further comprises:

a scraper slider which moves within the guide cover to support the scraper as it travels between the retracted position and the engaged position; and a spring member which biases the scraper slider towards the retracted position.

5. A waste ink removal system according to claim 4 wherein the spring member further comprises a bias component in a direction which minimizes a scraping force of the scraper to extend the life of the ink drop sensor.

6. A waste ink removal system according to claim 1, further comprising a debris receptacle having an opening.

7. A waste ink removal system according to claim 6, wherein:

the debris receptacle is located below a plane defined by the scraper when the scraper is moved between the retracted position and the engaged position; and the debris receptacle opening is located on an upper side of the debris receptacle between the ink drop sensor and the absorber, thereby allowing the ink residue to be pushed into the debris receptacle when the scraper is moved from the retracted position to the engaged position prior to the scraper contacting the absorber.

8. A waste ink removal system according to claim 1 wherein the ink drop sensor comprises an electrostatic ink drop sensor.

9. A printing mechanism, comprising:

a printhead which selectively ejects ink;

an ink drop sensor which receives ink from the printhead and accumulates an ink residue thereon; and a waste ink removal system for cleaning ink residue from the ink drop sensor, comprising:

a frame;

an actuator;

a scraper, supported by the frame, which scrapes ink residue from the ink drop sensor when moved by the actuator from a retracted position to an engaged position; and an absorber which the scraper contacts in the engaged position to remove the ink residue from the scraper.

10. A printing mechanism according to claim 9, further comprising a servicing member which services the printhead when the servicing member is moved from a first position to a second position, wherein the servicing member has a surface which acts as the actuator for moving the scraper.

11. A printing mechanism, according to claim 10 wherein the absorber further comprises an absorber deposition surface which receives and removes ink from the scraper when the scraper is in the engaged position.

12. A printing mechanism according to claim 11 wherein:

the drop sensor has a target surface which defines a plane; and the absorber deposition surface substantially lies in said plane.

13. A printing mechanism according to claim 12 wherein the frame further comprises a guide cover which controls motion of the scraper between the retracted position and the engaged position.

14. A printing mechanism according to claim 13 wherein the scraper further comprises:

a scraper slider which moves within the guide cover to support the scraper as it travels between the retracted position and the engaged position; and a spring member which biases the scraper slider towards the retracted position.

15. A printing mechanism according to claim 9, wherein the waste ink removal system further comprises a debris receptacle having an opening.

16. A printing mechanism according to claim 15, wherein:

the debris receptacle is located below a plane defined by the scraper when the scraper is moved between the retracted position and the engaged position; and the debris receptacle opening is located on an upper side of the debris receptacle between the ink drop sensor and the absorber, thereby allowing the ink residue to be pushed into the debris receptacle when the scraper is moved from the retracted position to the engaged position prior to the scraper contacting the absorber.

17. A printing mechanism according to claim 9, wherein the ink drop sensor comprises an electrostatic ink drop sensor.

18. A waste ink removal system for cleaning ink residue from an ink drop sensor in a printing mechanism, comprising:

a frame;

an actuator;

a scraper, supported by the frame, which scrapes ink residue from the ink drop sensor when moved by the actuator from a retracted position to an engaged position; and a debris receptacle having an opening into which the scraper pushes ink residue after scraping the ink residue from the ink drop sensor; and wherein the base further comprises a guide cover to control the direction of motion of the scraper when moved between the retracted position and the engaged position.

19. A waste ink removal system according to claim 18 wherein the scraper further comprises:

a scraper slider which moves within the guide cover to support the scraper as it travels between the retracted position and the engaged position; and a spring member to bias the scraper slider towards the retracted position.

20. A method of cleaning ink residue from an ink drop sensor in a printing mechanism, comprising:

moving a scraper between a retracted position and an engaged position;

scraping ink residue from the ink drop sensor with the scraper while moving to the engaged position; and removing ink residue from the scraper surface, while the scraper is in the engaged position, through contact with an absorber; and biasing the scraper in an additional direction to minimize a scraper force imparted by the scraper against the ink drop sensor.

21. A method according to claim 20 for removing ink residue, comprising:

translating an inkjet printhead servicing member between a first position and a second position as an actuation to move the scraper between the retracted and engaged positions.

22. A method according to claim 21 for removing ink residue, further comprising biasing the scraper towards the retracted position.

23. A method according to claim 22 for removing ink residue further comprising:

after removing ink from the scraper surface, moving the printhead servicing member from the second position back towards the first position; and allowing the spring member to retract the scraper towards the retracted position as the printhead servicing member moves back to said first position.

24. A method according to claim 20 for removing ink residue, further comprising:

providing a debris receptacle with a debris receptacle opening, wherein said receptacle is located below a plane created by the scraper when the scraper is moved from the retracted position to the engaged position; and wherein the debris receptacle opening is located on the upper side of the debris receptacle between the ink drop sensor and the absorber.

25. A method according to claim 24 for removing ink residue, wherein after scraping ink residue from the ink drop sensor, pushing the ink residue into the debris receptacle.

26. A method according to claim 25 for removing ink residue, wherein:

after pushing the ink residue into the debris receptacle, contacting an absorber with the scraper; and absorbing ink residue which remains on the scraper through capillary action of the absorber.

* * * * *